United States Patent [19]

Grenia

[11] 4,213,653

[45] Jul. 22, 1980

[54] METHOD OF MINING OF THICK SEAM MATERIALS

[75] Inventor: James D. Grenia, Concord, Calif.

[73] Assignee: Bechtel International Corporation, San Francisco, Calif.

[21] Appl. No.: 896,824

[22] Filed: Apr. 17, 1978

[51] Int. Cl.[2] ..... E21C 41/00

[52] U.S. Cl. ..... 299/11; 299/18; 299/19

[58] Field of Search ..... 299/2, 11, 18, 33, 19; 61/267; 175/53

[56] References Cited

U.S. PATENT DOCUMENTS

| | | | |
|---|---|---|---|
| 3,326,003 | 6/1967 | Marconi | 405/267 |
| 3,460,867 | 8/1969 | Cameron et al. | 299/2 |
| 3,469,405 | 9/1969 | Reinhold | 299/11 X |
| 3,527,500 | 9/1970 | Thompson | 405/288 X |
| 4,059,963 | 11/1977 | Wayment | 299/11 X |

*Primary Examiner*—Ernest R. Purser

*Attorney, Agent, or Firm*—John L. McGannon

[57] ABSTRACT

A method of mining thick seam materials is performed by forming a pair of generally horizontal, vertically spaced, vertically aligned passes or drifts in one side of the thick seam. A number of contiguous vertical holes are drilled in the material from the lower to the upper drift to form a relatively large opening extending the length of the drifts. This large opening is then filled with low grade concrete to support the overburden and, after the concrete is set, a second pair of generally horizontal, vertically spaced, vertically aligned drifts are formed adjacent to the first mentioned drifts and the foregoing process is repeated. The above steps are continued until the entire seam of material has been removed. Each individual hole between an upper drift and a lower drift is formed by first drilling a relatively small diameter hole from the upper drift to the lower drift, following which a relatively large diameter reamer is then coupled to the drill shaft and the drill shaft is raised and rotated to cause the reamer bit to mine the materials from the bottom drift to the top drift, the materials falling into the lower drift and being removed in any suitable manner.

11 Claims, 7 Drawing Figures

METHOD OF MINING OF THICK SEAM MATERIALS

This invention relates to improvements in mining techniques and, more particularly, to a method of mining a subterranean thick seam resource that is not now being mined or only partially mined by present methods.

BACKGROUND OF THE INVENTION

A substantial portion of thick seamed resources such as coal, salt, phosphate, potash and the like, are situated under a thick overburden of rock and overlying soil. Because of the depth of the overburden, strip mining of these resources, particularly western coal, becomes extremely costly and essentially prohibitive. This is because of the high cost involved in first removing the overburden, and then the cost of resurfacing the ground to meet environmental requirements. For this reason, a need has arisen for an improved method of mining resources of this type to minimize these costs, i.e. provide a means of extracting the resource without essentially either removing the overburden or damaging the surface above the resource to be extracted.

Prior art U.S. Pat. Nos. which are considered pertinent are as follows:

2,823,900
3,167,354
3,892,442
3,905,430

These patents do not involve removal of the overburden, but they do not provide an adequate technique for preserving surface regularity after mining below the surface. U.S. Pat. No. 3,892,442 describes the use of foam for filling subterranean cavities, but that is expensive, cumbersome to use, and limits the movement of personnel and equipment in drifts or passes below the surface.

SUMMARY OF THE INVENTION

The present invention satisfies the aforesaid need by providing an improved method of extracting resource materials of the type described in a relatively thick seam, such as a seam having a thickness of twenty or more feet. The method includes forming a pair of upper and lower drifts or passes at one side of a thick seamed resource to be mined with the two drifts being generally vertically aligned with each other and about horizontal in grade. Overlapping holes are successfully drilled between the drifts to remove the resource material and to form a single, generally rectangular hole, following which the single hole and the upper and lower drifts are filled with a low grade concrete for supporting the overburden above the upper drift. Then, additional pairs of upper and lower drifts are successively formed, drilled and filled with concrete in the same way until the entire block of material has been mined. What is left in place of the mined material is a series of concrete walls adjacent to each other which support the overburden and maintain the surface contours above ground.

The present invention provides a method which, although not considered inexpensive, provides an efficient technique of near total extraction of a valuable resource, part of which resource would be lost by use of present or current mining methods. It is estimated that costs arising from the back-filling of concrete will be about equal to or slightly higher than the costs applied to overburden stripping of conventional mining methods. The energy used in placing the back-fill will be much less than the energy expended in a large scale overburden stripping operation. As the present invention of thick seam removal is applied, extraction costs may generally be about the same as prior art underground extraction costs yet nearly total recovery of the resource is possible, a feature not capable of being achieved with conventional methods.

The primary object of this invention is to provide an improved method of mining subterranean thick seam materials without seriously disturbing the overburden above the materials yet provide a substantial removal of all the materials.

A further object of this invention is to provide a method of the type described in which a series of relatively large overlapping holes are drilled between an upper drift and a lower drift to remove portions of the material between the drifts, so that the relatively large, substantially rectangular hole formed by the overlapping holes can be filled with a low grade concrete for support purposes, and thereafter the remainder of the materials can be mined progressively and successively by repeating the drilling, removing and filling steps in successive pairs of upper and lower drifts until all of the material has been mined and the overburden is fully supported from beneath.

Other objects of this invention will become apparent as the following specification progresses, references being had to the accompanying drawings for an illustration of the operation of the method.

IN THE DRAWINGS

Figure 1:
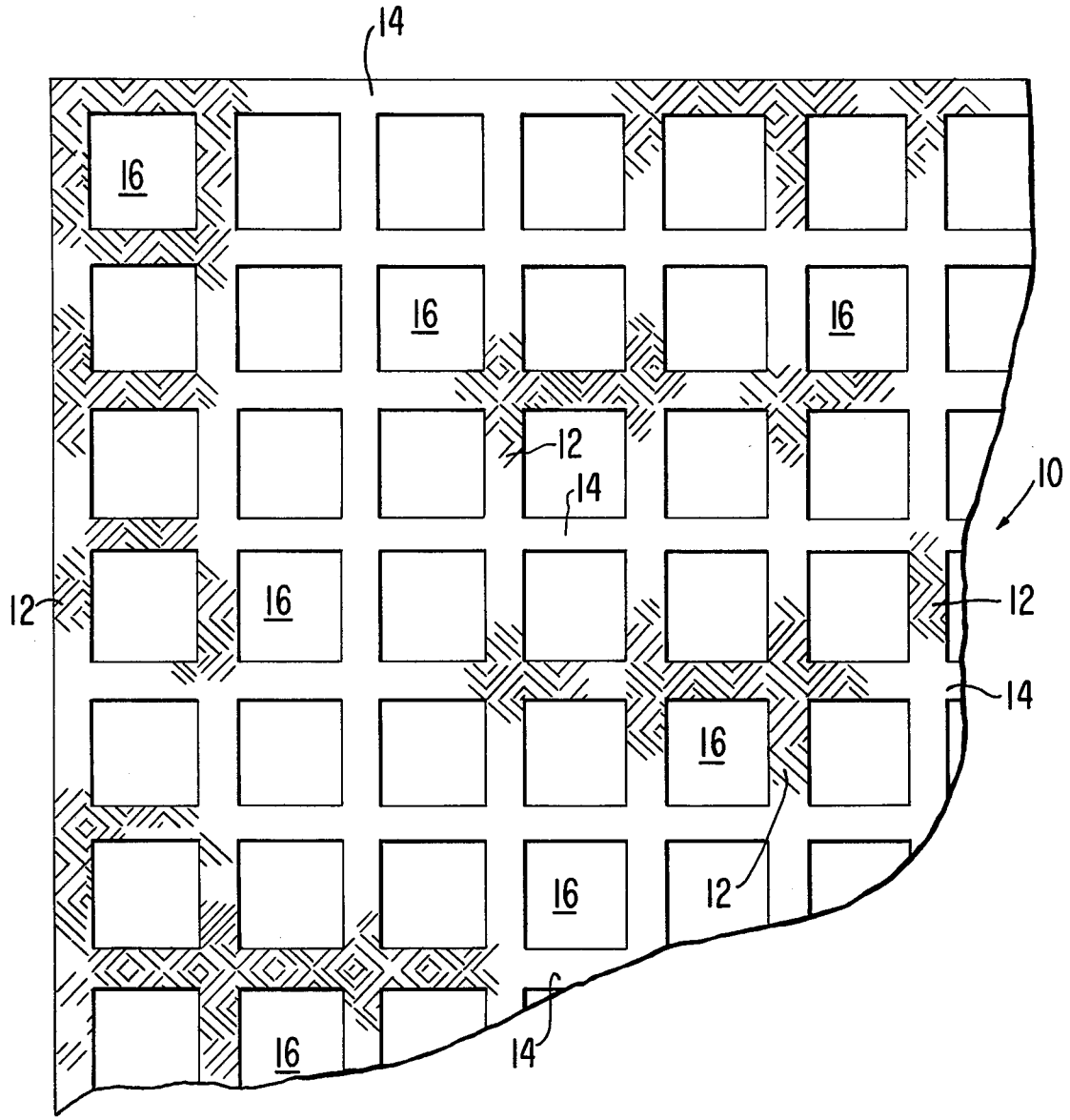
FIG. 1 is a top plan view of the waffle-like pattern of drifts formed at one level below ground for use in carrying out the method of the present invention.
Figure 2:
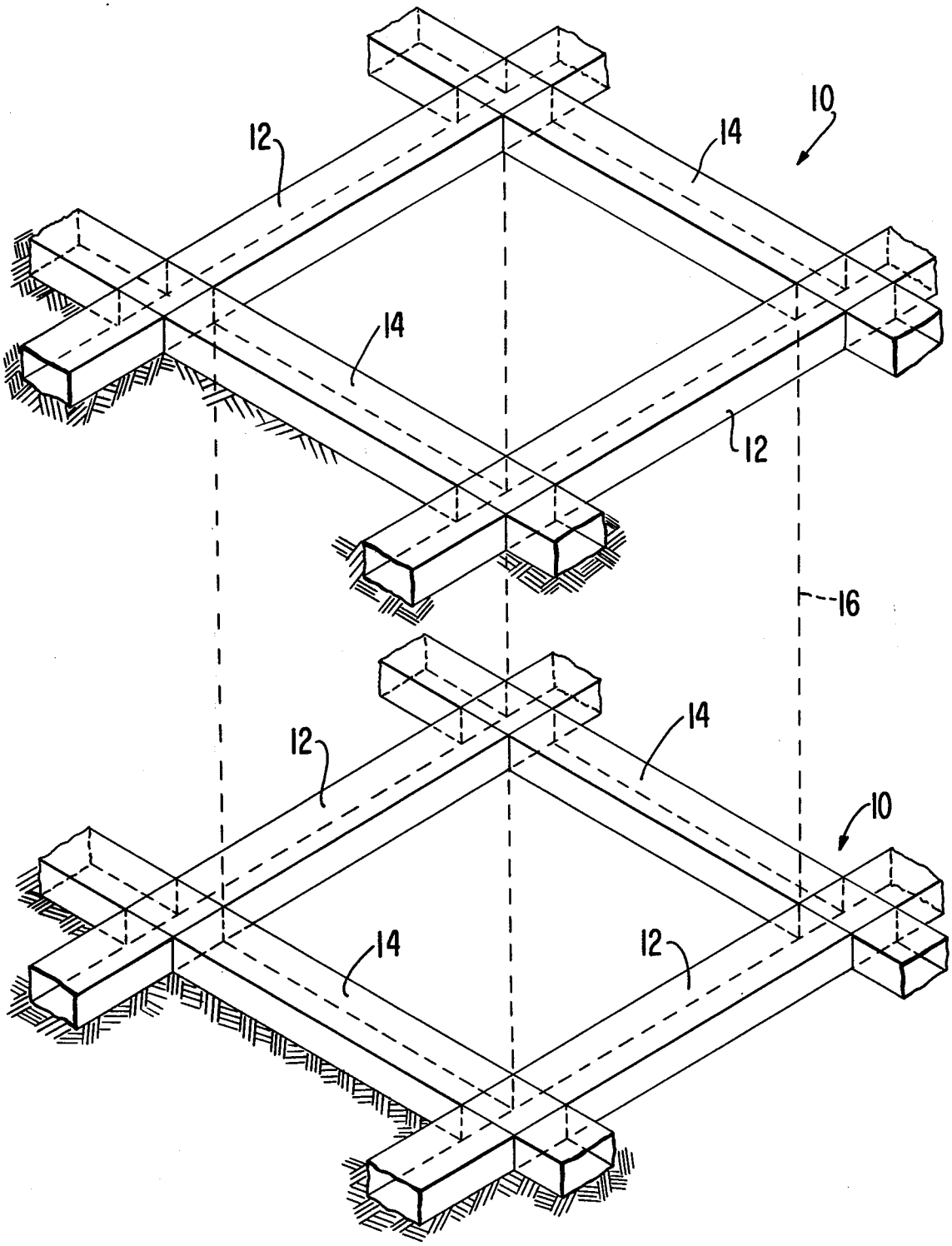
FIG. 2 is an enlarged, fragmentary perspective view of the waffle pattern at two such levels below ground.

In carrying out the method of the present invention, a waffle-like pattern 10 of drifts is first formed at two levels below ground, namely at the top and the bottom or base of a thick seam of materials to be mined. This pattern allows ventilation at all locations and permits movement of personnel and equipment to different parts of the pattern without difficulties. For purposes of illustration, waffle-like pattern 10 is shown in FIG. 1 and is comprised of a number of first drifts or passes 12 extending in one direction essentially parallel with each other and a plurality of second drifts or passes 14 extending in a direction essentially perpendicular with that of drifts 12. These drifts, being generally horizontal, define the outer side boundaries of respective blocks 16 of the material to be mined, the drifts being formed in any known continuous mining method. FIG. 2 shows a pair of vertically spaced drift patterns 10 at two levels with each drift 12 and 14 of each pattern 10 being in vertical alignment with corresponding drift 12 and 14 of the other pattern 10.

For example, the upper drift pattern 10 can be at an elevation of 200 feet below the surface of the ground and the lower drift pattern 10 can be 400 feet below the ground surface so that a pair of aligned drifts 12 are at one side of a boundary of a solid 200 foot thick seam or block of the resource material which can be several thousand yards square. The drifts connect to ingress and egress passageways through which the mined resource will be sent to the surface.

To initiate the extraction of the resource material, which will hereinafter be referred to as coal, a relatively small diameter hole 18 (FIG. 5), such as 10 inches in diameter, is drilled in the corner of the block from the upper drift 12 to the lower drift 12 for use as a pilot hole for mining upwardly with a large diameter reaming bit. When the drill shaft reaches the lower drift 12 during drilling of hole 18, the small bit on the shaft is removed and a much larger diameter bit, such as a 12 foot reaming bit, is attached to the shaft. The shaft is then raised while being rotated so that the reaming bit bores a 12 foot circular hole 20 (FIGS. 3 and 5) from the lower drift to the upper drift. The coal falling downwardly during the drilling of the large hole will fall to the bottom of the hole and be removed. For example, the coal may fall into a collecting hopper positioned at the bottom of the hole, then onto a standard ratio feeder, and then onto a conveyor which will remove the coal to the exit or shaft for further movement to the surface.

Figure 3:
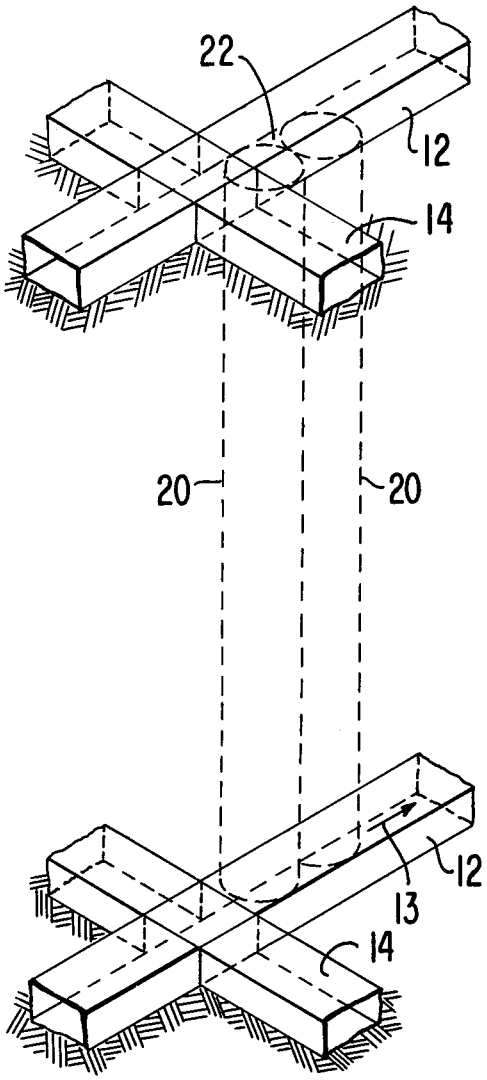
FIG. 3 is a view similar to FIG. 2 but illustrating the way in which a number of vertical, overlapping holes are drilled between two levels to carry out the method of the present invention.

As shown in FIG. 3 by the arrow 13 in the lower drift, the extracted coal is preferentially removed under the protection of the remaining coal, so as not to expose either personnel or equipment to falling material in the large open formed area. However, the extracted coal could be removed in the other direction if adequate protection is provided.

While reaming from the top downwardly can be done, it is not preferred because of the difficulty in lifting the extracted coal from a hole.

Figure 5:
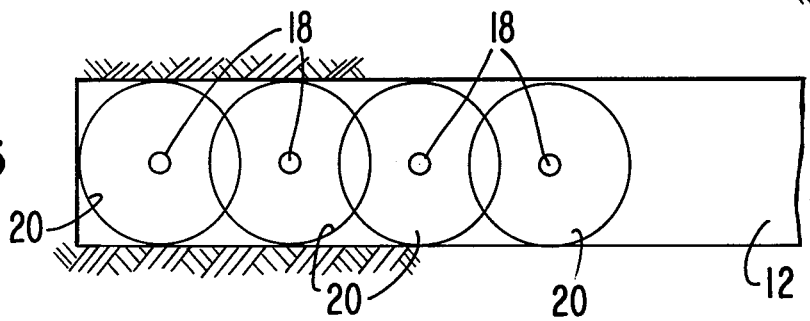
FIG. 5 is a top plan view of a portion of one drift, showing a way in which the vertical holes overlap each other.
Figure 6:
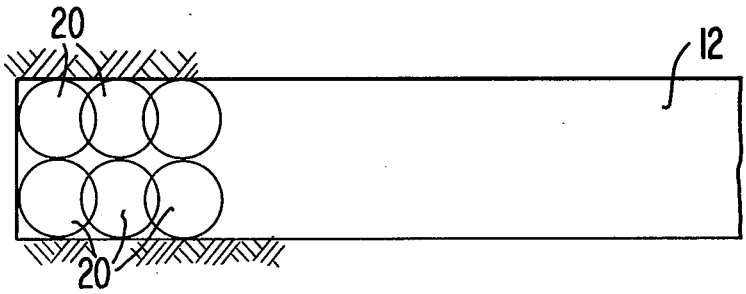
FIG. 6 is a view similar to FIG. 5 but showing a different type of pattern of vertical holes which overlap each other.

When the first hole 20 is completed, the large reaming bit will be lowered and repositioned in the lower drift for use in forming the next adjacent large hole 20. The next step is to drill a second relatively small hole 18 next to the adjacent large hole 20 from the upper drift to the lower drift, following which the relatively large reamer bit is attached to the drill shaft and raised as the shaft is rotated to form the next adjacent large hole 20 which overlaps the first hole 20 as shown in FIG. 5. In the alternative, a series of small diameter holes 18 can be first drilled from the upper drift to the lower drift before the first large hole is drilled. Moreover, the pattern of large holes 20 can be of the form shown in FIG. 6, if desired, or in any other pattern depending upon the nature of the resource and economies.

A series of large holes 20 are successively drilled as described above to form a generally rectangular, single hole 22 (FIG. 3) extending longitudinally the length of the upper and lower drifts and extending therebetween. This single hole 22 places the upper and lower drifts 12 in communication with each other and after it has been formed, hole 22 and the lower drift 12 is filled with a mixture of gravel, sand, Portland cement and soil to make a low grade concrete and to establish a bearing block or main wall 24 (FIG. 4) to support the overburden above the upper drift 12, such as the fill material having a strength of 3,000 pounds per square inch. The fill could also be a mixture of cement and soil or cement and sand.

Figure 4:
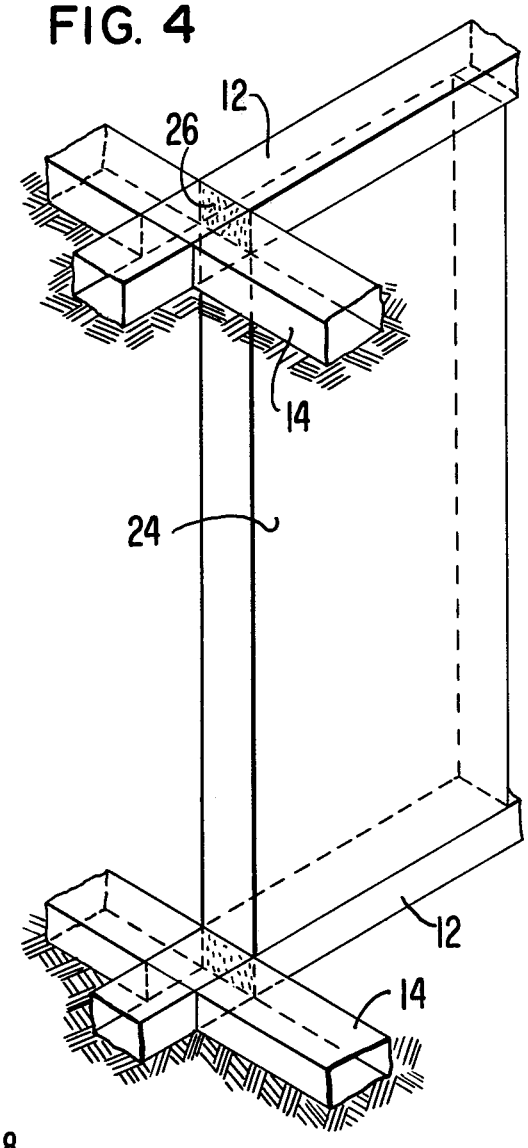
FIG. 4 is a view similar to FIG. 3 but showing the concrete block formed by filling the vertical, overlapping holes with a low-grade concrete for supporting an overburden above the upper drift.

After the concrete back-fill 24 in hole 22 has sufficiently hardened, such as after 24 and 48 hours, any drilling and handling equipment remaining in the upper drifts 12 will be removed and the upper drift above the fill 24 in hole 22 will be filled with a concrete pack wall 26 (FIG. 4). Thus, the pack wall will form a continuation of the upper margin of wall 24 and will engage the ceiling surface of the upper drifts 12 in supporting relationship to the overburden thereabove.

Figure 7:
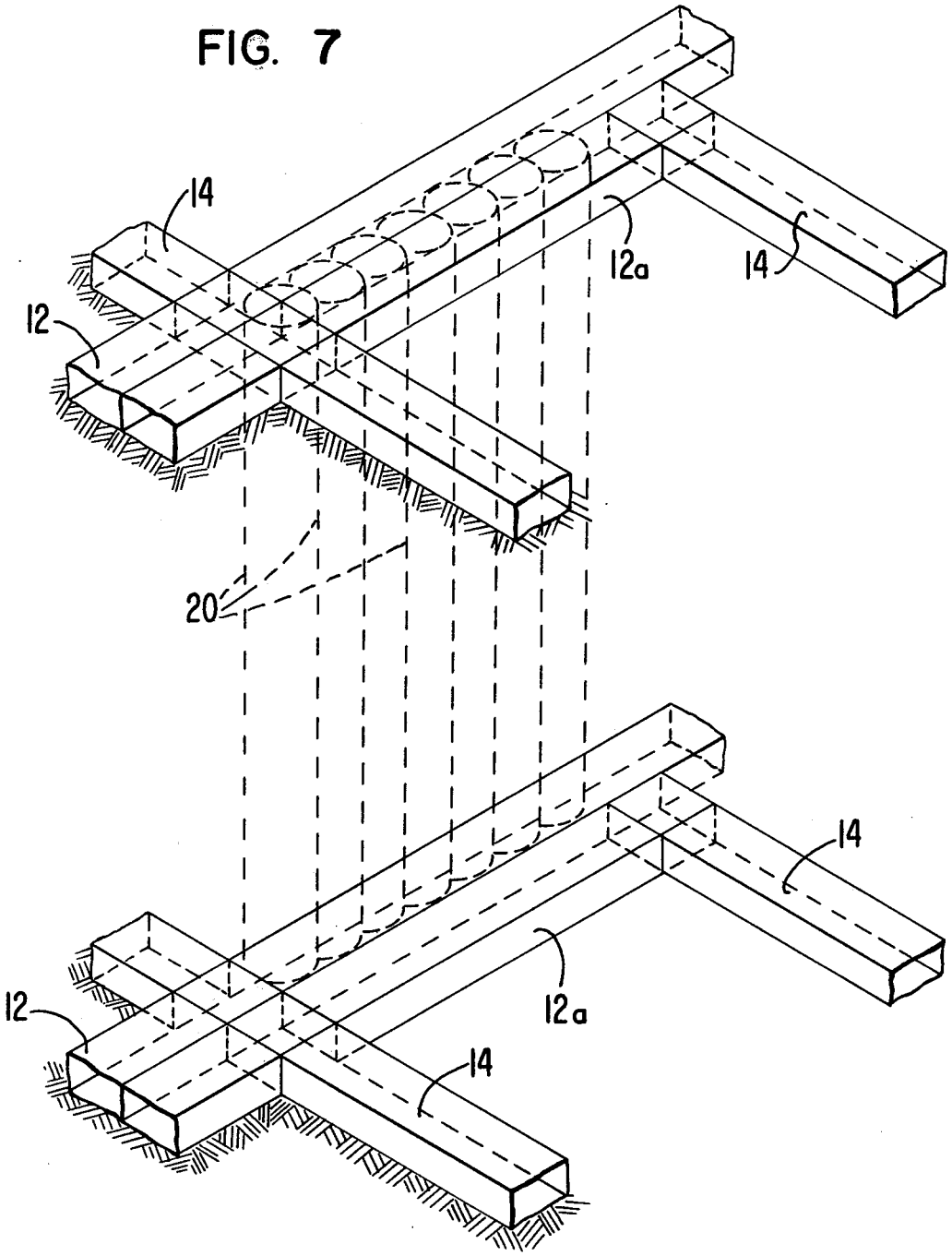
FIG. 7 is a view similar to FIG. 2 but showing an additional pair of vertically aligned drifts adjacent to a first pair of drifts filled with low-grade concrete.

While the concrete fill is hardening, the drilling equipment will be used to accomplish the same operations on another block in the mining area. A second pair of vertically aligned drifts **12*a* immediately adjacent to the first mentioned pair of drifts 12 will be formed as shown in FIG. 7 after the bearing wall in the first pair of drifts has been formed. The drilling and handling equipment is moved back to near the corner of the first drilling point and a series of holes 18 and 20 will be formed between the second pair of drifts in the manner described above with respect to the first pair of drifts to form a second, generally rectangular single, relatively large hole between the second pair of drifts, the second hole being essentially like the first hole 22 as shown in FIG. 3. Then, concrete fill will be added to a newly formed second hole and to the lower and upper drifts as described above to a form a main wall which are essentially like the main wall 24 and the pack wall 26 shown in FIG. 4 and a pack wall. The aforesaid process will continue with the successive formation of large holes 22 and then walls 24 and 26 in the manner described above until the entire block 16** of coal has been mined. When a mining area has been mined between the 200 and 400 foot elevations, the same process may be repeated at lower levels in the ground if thick seams exist there.

As stated above, the present invention is not limited to the mining of coal. It may be used for trona, potash and other natural resources where the thickness of the seams warrants the use of this method of mining. The seam, for example, could be a narrow vertical seam 10 feet wide and several thousand feet deep and long through the ground. The present invention may also be used in old mines to remove the remaining coal or other resource material left for support in the mines using conventional methods or left after caving. The invention may be used from the surface and may also be used in conjunction with open pit mining where the stripping from the open pit may be used for the backfill material with cement.

The invention has several operating advantages, including the fact that the invention allows for more efficient ventilation, less maintenance, easier water control, less support in development drifts and stopes and the like. It will also permit better water conservation than a conventional mine since, with this invention, the horizontal drifts and the external sidewalls of the entire mining area could be fully concreted to prevent the entrance of water. This would establish an essentially impervious water table in the foregoing illustration at approximately 200 feet, preventing surface water from going downwardly through the excavated areas which would happen with conventional mining. It will also permit substantially greater recovery of coal, such as 90% or better, from an underground mine than any conventional methods which typically yield only 50% to 70% recovery.

In the claims:

1. A method of mining a thick seam resource material below an overburden comprising: forming a first pair of vertically spaced, generally vertically aligned drifts in the seam; forming a series of overlapping holes in the material of the seam with the holes extending between the drifts; removing the material extracted by the forming of the holes; filling the holes and the first pair of drifts with a load-bearing material to form a bearing wall for use in supporting the overburden; forming, successively, additional pairs of vertically spaced, generally vertically aligned drifts adjacent to respective walls in previously formed drift pairs; and repeating, for each additional pair of drifts, respectively, the hole forming, removing and filling steps to mine a respective part of the seam and to form a respective bearing wall adjacent to a previously formed bearing wall.

2. A method as set forth in claim 1, wherein the repeating step for each pair of drifts is performed before the next successive pair of drifts is formed.

3. A method as set forth in claim 1, wherein the forming of each hole includes reaming the material from the lower drift to the upper drift.

4. A method as set forth in claim 3, wherein the forming of each hole includes drilling a pilot hole in the seam before the corresponding reaming step.

5. A method as set forth in claim 3, wherein the removing step for each pair of drifts includes collecting the extracted material in the corresponding lower drift, and conveying the extracted material to a location remote from the last-mentioned lower drift.

6. A method as set forth in claim 1, wherein the filling step for each pair of drifts includes putting concrete in the drifts and the holes therebetween and allowing the concrete to set to form the bearing wall.

7. A method as set forth in claim 6, wherein said putting step includes directing concrete into the upper drift after the concrete in the hole and lower drift has set to a hardened condition to thereby extend the bearing wall in the upper drift to the overburden above said concrete.

8. A method as set forth in claim 1, wherein each additional pair of drifts is formed at locations in the seam contiguous to corresponding drifts of a previously formed drift pair.

9. A method as set forth in claim 1, wherein said forming steps includes laying out a waffle-like pattern of drifts at each of a pair of vertically spaced levels in the seam with each pattern having a series of first, spaced, generally parallel drifts and a series of second, spaced, generally parallel drifts transverse to and communicating with the first drifts.

10. A method as set forth in claim 1, wherein each hole has a diameter approximately equal to the width of an adjacent drift, the distance between the centers of adjacent holes being less than the diameter of the holes.

11. A method as set forth in claim 1, wherein each hole has a diameter approximately equal to one-half the width of each adjacent drift, there being a first row of overlapping holes along one side of each corresponding drift and a second row of overlapping holes along the opposite side of each adjacent drift adjacent the holes of the first row overlapping adjacent holes of the second row.

* * * * *